US008739702B2

(12) United States Patent
Korolik et al.

(10) Patent No.: US 8,739,702 B2
(45) Date of Patent: Jun. 3, 2014

(54) PRINTING PLATE LOADING APPARATUS FOR LOADING PLATES FROM EITHER A PLATE STACK OR CASSETTE

(75) Inventors: Pavel Korolik, Petah-Tikwa (IL); David Tulipman, Binyamina (IL)

(73) Assignee: Eastman Kodak Company, Rochester, NY (US)

( * ) Notice: Subject to any disclaimer, the term of this patent is extended or adjusted under 35 U.S.C. 154(b) by 1231 days.

(21) Appl. No.: 12/269,910

(22) Filed: Nov. 13, 2008

(65) Prior Publication Data

US 2010/0116162 A1 May 13, 2010

(51) Int. Cl.
*B41L 47/14* (2006.01)
*B41F 27/12* (2006.01)

(52) U.S. Cl.
USPC ..... 101/477; 101/480

(58) Field of Classification Search
USPC ..... 101/477, 480
IPC ..... B41L 47/14
See application file for complete search history.

(56) References Cited

U.S. PATENT DOCUMENTS

| | | | | |
|---|---|---|---|---|
| 7,229,241 | B2 | 6/2007 | Solomon et al. | |
| 2004/0187723 | A1* | 9/2004 | Koizumi et al. | 101/477 |
| 2005/0217524 | A1* | 10/2005 | Miyoshi | 101/477 |
| 2006/0245870 | A1 | 11/2006 | Blake et al. | |
| 2007/0169655 | A1* | 7/2007 | Cummings et al. | 101/477 |
| 2007/0227387 | A1* | 10/2007 | Takeda et al. | 101/477 |
| 2009/0223399 | A1* | 9/2009 | Lassen | 101/477 |
| 2011/0041717 | A1* | 2/2011 | Takahashi et al. | 101/477 |

FOREIGN PATENT DOCUMENTS

| | | | |
|---|---|---|---|
| EP | 1 772 262 | A1 | 4/2007 |
| GB | 2 409 189 | A | 6/2005 |
| WO | WO 2006/091558 | A1 | 8/2006 |

* cited by examiner

*Primary Examiner* — Leslie J Evanisko
(74) *Attorney, Agent, or Firm* — Nelson Adrian Blish

(57) ABSTRACT

A printing plate loading apparatus (10) configured to load plates into a printing plate imaging device (120) includes a plate pallet loading system (100) for loading plates from originally packed plate pallet into the printing plate imaging device. Additionally a plate cassette unit (110, 310) connected to the plate pallet loading system, which is configured to receive a single cassette (112) from the plate cassette unit and to load plates from the single cassette directly into the printing plate imaging device.

5 Claims, 3 Drawing Sheets

PRINTING PLATE LOADING APPARATUS FOR LOADING PLATES FROM EITHER A PLATE STACK OR CASSETTE

CROSS REFERENCE TO RELATED APPLICATIONS

Reference is made to commonly-assigned U.S. patent application Ser. No. 12/045,058, filed Mar. 10, 2008, (now U.S. Pat. No. 7,888,664) entitled PLATE PALLET ALLIGNMENT SYSTEM, by Korolik et al., the disclosure of which is incorporated herein.

FIELD OF THE INVENTION

The present invention relates to an apparatus and methods for loading plate cassettes into a pallet loader connected to a plate imaging device.

BACKGROUND OF THE INVENTION

A variety of systems and applications use stacks of sheets, or plates, or both, which may be made of metal, paper, plastic, and the like. Printing plates (hereinafter singly or collectively referred to as "plates") are typically stacked on plate pallets, which house the plates and facilitates their protection, transportation, and handling.

A system for handling printing plates will generally use cassettes having specific dimensions for a limited number of plates, for example 30-50 plates. Cassettes can usually be set to contain plates of various sizes, but all plates in the same tray are of one size. The plates may be manually removed from the plate pallets and inserted into the cassettes for use by the plate imaging system. Plates packed in plate pallets are separated by intermediate paper sheets, hereinafter referred to as separation paper.

Cassettes containing printing plates are both heavy and bulky, and moving such trays requires complicated and expensive mechanisms and is time consuming; specifically, during the loading of the plates from the plate pallets into the cassettes. There is a widely recognized need for an automatic and efficient handling system for feeding plates directly from the original plate pallet into the imaging device, while maintaining precise alignment of the plates during the plate feeding process. This need is addressed by the invention described in commonly-assigned U.S. patent application Ser. No. 12/045,058.

The plate stacks received from plate manufacturers often comprised of at least 600 plates. Each plate is separated from the next by a separation paper, and the entire stack of plates is on a plate pallet for a job requiring a number of plates of the same size, loading plates from a plate pallet to an imaging device is preferred to loading plates from a cassette. Plates may shift or fall from their original position, however, during transportation of the pallet into the plate loading device or during the loading process of plates into the imaging unit. The shift can occur also during shipping of the plate stacks from the manufacturer to the end user. Thus, there may be some drawbacks to loading an imaging device exclusively from a plate pallet.

The invention provides a solution for facilitating plate loading into an imaging device through an automatic plate loader (APL), capable of loading plates directly from plates in a plate pallet, as well as from plates that are fetched from plate cassettes.

SUMMARY OF THE INVENTION

Briefly, according to one aspect of the present invention an apparatus for loading printing plates is introduced. The printing plates can be loaded into an imaging device either directly from plate pallet placed in an automatic pallet loader (APL), or from a cassette brought into the APL from a single cassette unit (SCU) or a multi-cassette unit (MCU).

These and other objects, features, and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

The present invention describes apparatus and methods for receiving a pallet of printing plates in an original manufactured form and loading the plates directly into a computer-to-plate (CTP) imaging device. The plate pallet is brought into an automatic pallet loading (APL) device attached to the CTP device. The APL receives the bulk of plates originally packed on a pallet by using regular fork lift machinery.

Alternatively, plates can be loaded into the imaging device from a single cassette unit (SCU) or a multi-cassette unit (MCU). The MCU carries a plurality of cassettes and each cassette carries plates in predefined size. A cassette with plates is selected from the SCU or the MCU and is moved into the APL, for further loading plates into the imaging device.

Figure 1:
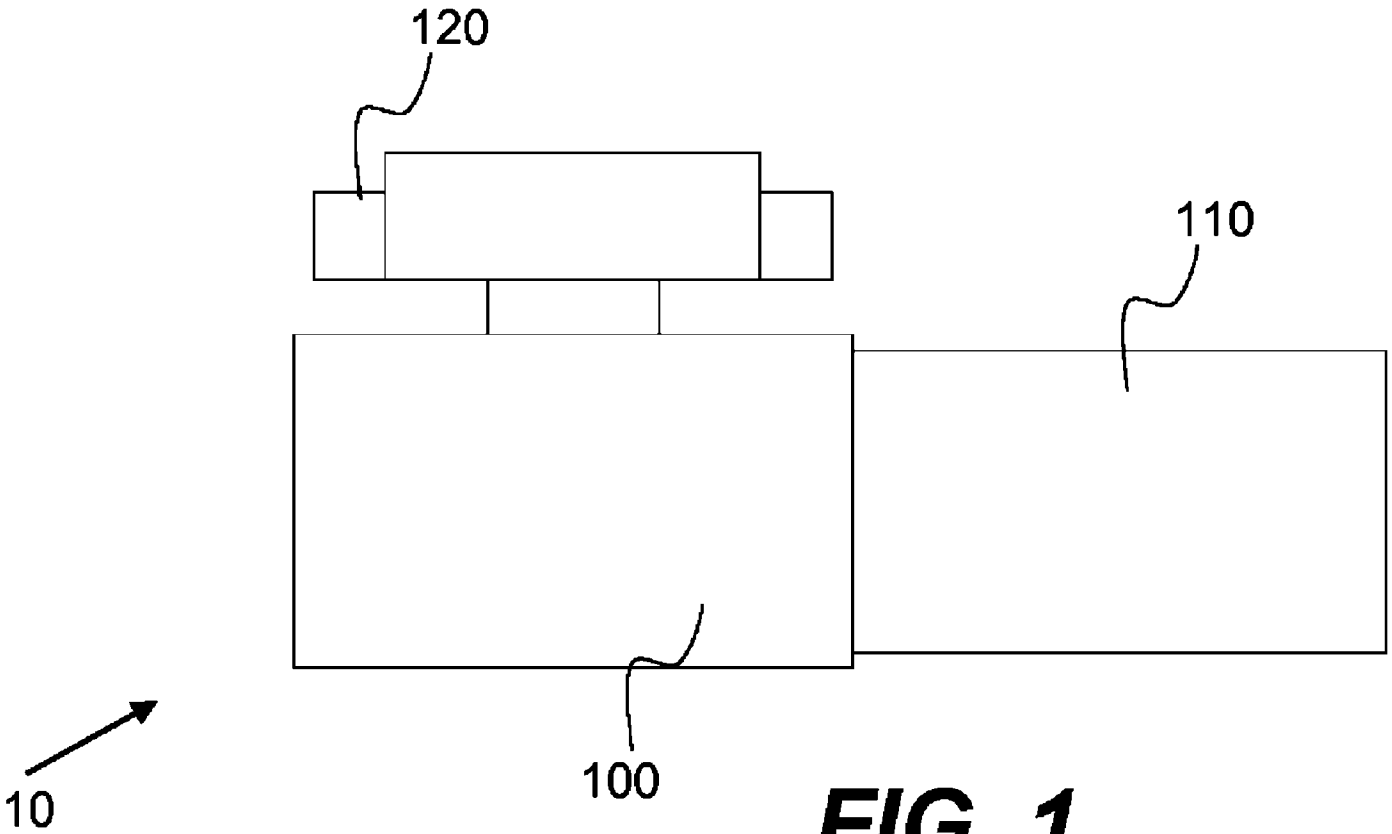
FIG. 1 is a schematic configuration showing a top view of an imaging device connected to an automatic plate loader (APL), wherein the APL is connected to a multi cassette unit (MCU) and is capable to receive cassettes from the MCU into the APL.

FIG. 1 shows a printing plate loading apparatus 10. The apparatus includes an imaging device 120, an automatic plate loader (APL) 100, and a cassette unit. The imaging device 120 is connected to an automatic plate loader device (APL) 100. The imaging device 120 is capable to load printing plates directly from APL 100. In addition, APL 100 is connected to a multiple cassette unit (MCU) 110. APL 100 is capable to receive cassettes from MCU 110, wherein imaging device 120 load the printing plates directly from the cassette previously received from MCU 110 into APL 100.

Figure 2:
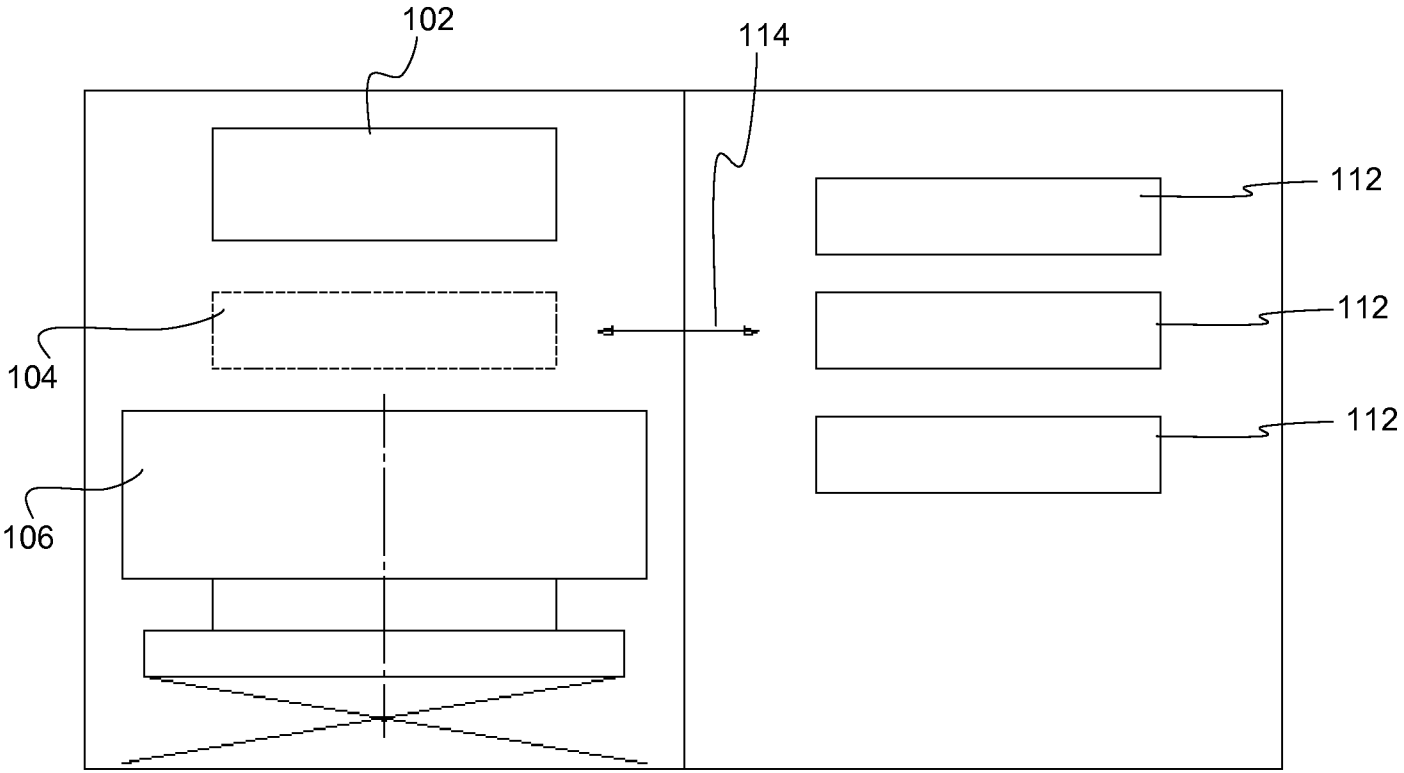
FIG. 2 is a schematic showing a side view of a plurality of cassettes in the MCU to be loaded into the APL.

FIG. 2 shows cassettes with various sizes 112 stored in MCU 110. The MCU 110 is connected to APL 100. A cassette is selected from the various cassettes 112 and is moved to the selected cassette position 104 in APL 100. The selected cassette is moved between MCU 110 and APL 100 via a cassette bi-directional path 114. Plate loading system 102 of the imaging device 120 loads plates directly from plate pallet stack 106 or alternatively from a selected cassette positioned in the selected cassette position 104 of APL 100.

The invention disclosed herein shows several plate loading sources, such as directly from pallet stack 106 or from a selected cassette moved into cassette position 104, integrated into a single system, thus solving a practical need at the printing sites.

Most of the plates used for imaging will be fetched from pallet stack 106, where the most popular plate size is stacked. In addition the MCU 110 will comprise of various cassettes 112, each cassette 112 will carry plates in different sizes. In case where a different size plate than the size of the plates stacked in stack 106 is needed, and one of cassettes 112 carries relevant size plates, the relevant cassette 112 will be selected. The selected cassette will be moved from MCU 110 into APL 100 via the cassette bi-directional path 114 and will be positioned in the selected cassette position 104 of APL 100.

Figure 3:
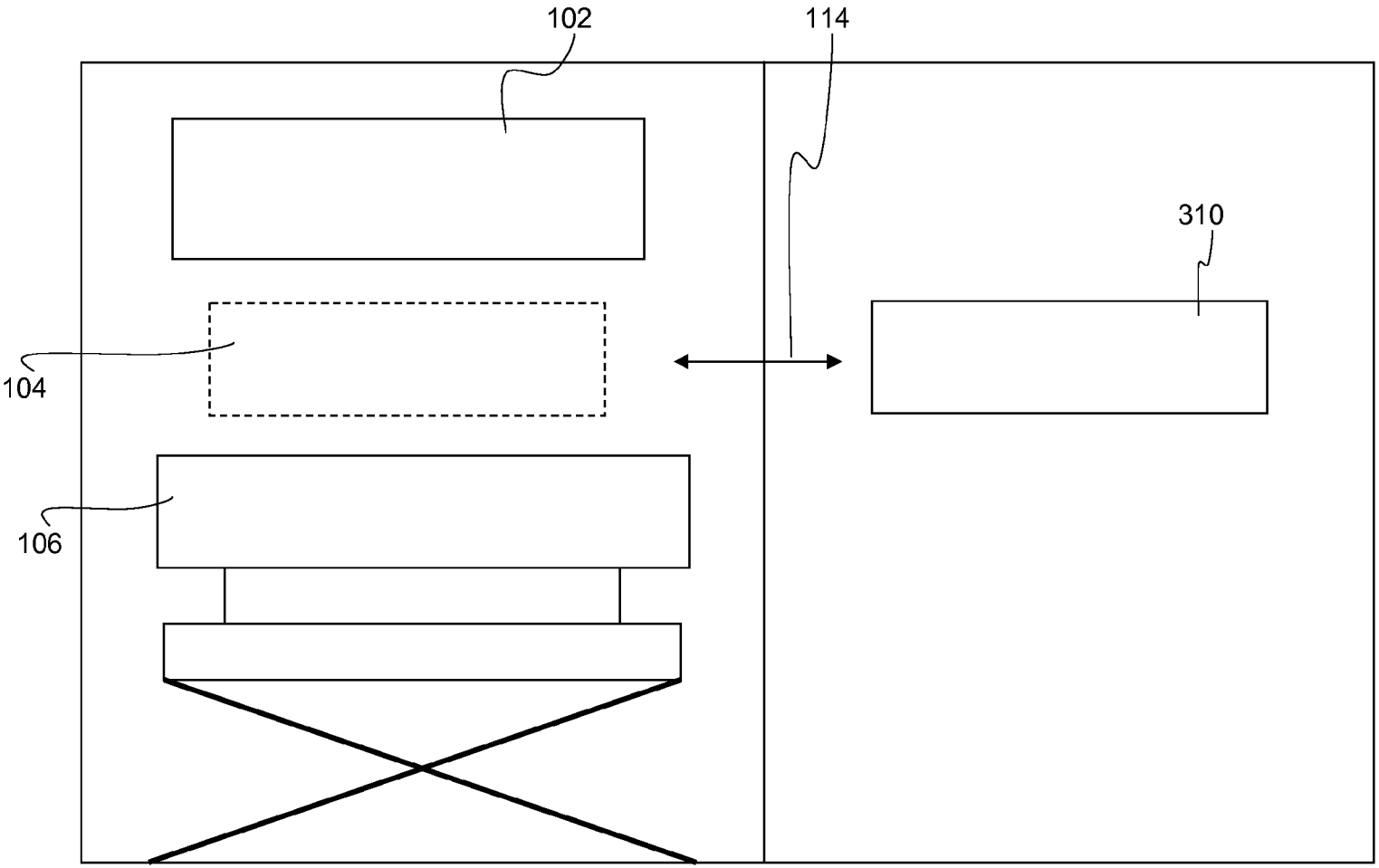
FIG. 3 is a schematic showing a side view of a cassette loaded from a single cassette unit (SCU) into the APL.

Similarly, plates can be loaded into the imaging device from a single cassette unit or a (SCU). FIG. 3 shows SCU 310 that carries one cassette filled with plates of a certain size. The cassette with plates is moved into the APL 100 for loading plates into the imaging device via plate loading system 102.

The invention has been described in detail with particular reference to certain preferred embodiments thereof, but it will be understood that variations and modifications can be effected within the scope of the invention.

PARTS LIST

10 printing plate loading apparatus
100 automatic plate loader (APL)
102 plate loading system
104 selected cassette position
106 pallet stack
110 multiple cassette unit (MCU)
112 cassettes with various sizes
114 cassette bi-directional path
120 imaging device
310 single cassette unit (SCU)

The invention claimed is:

1. A printing plate loading apparatus configured to load plates from either a plate stack or cassette onto a printing plate imaging device comprising:

a plate pallet wherein said plate pallet comprises a stack of printing plates positioned on said plate pallet wherein said stack of printing plates are positioned on said plate pallet as originally packed at a plate manufacturing site and wherein said stack of printing plates are not from a cassette;

an automatic plate loader (100);

a plate cassette unit (110, 310) wherein said automatic plate loader is configured to receive a cassette (112) from said plate cassette unit via a cassette bi-directional path (114) into a selected cassette position in said automatic plate loader; and a plate loading system (102) in said automatic plate loader wherein said plate loading system is configured to load said printing plates directly from said stack of printing plates positioned on said plate pallet into said imaging device or alternatively to load said printing plates from a cassette which is in said selected cassette position into said imaging device.

2. The printing plate loading apparatus according to claim 1 wherein said plate cassette unit is comprised of a plurality of cassettes.

3. The printing plate loading apparatus according to claim 1 wherein said plate cassette unit is comprised of a single cassette unit.

4. The printing plates loading apparatus according to claim 3 wherein the cassette in said single cassette unit is configured to carry plates with different sizes.

5. The printing plate loading apparatus according to claim 1 wherein said plate stack is configured to carry plates with different sizes.

* * * * *